United States Patent [19]

Wanatowicz, Jr. et al.

[11] 4,453,063

[45] Jun. 5, 1984

[54] KEYSWITCH CONFIGURATION WITH TORQUE ROD HOLDER

[75] Inventors: Edward W. Wanatowicz, Jr., Elk Grove Village; Dennis G. Boma, Streamwood, both of Ill.

[73] Assignee: Illinois Tool Works Inc., Chicago, Ill.

[21] Appl. No.: 520,039

[22] Filed: Aug. 3, 1983

[51] Int. Cl.[3] ..... H01H 3/12

[52] U.S. Cl. ..... 200/340

[58] Field of Search ..... 400/496; 200/340

[56] References Cited

U.S. PATENT DOCUMENTS 3,292,761 12/1966 Erpel ..... 400/496

4,392,037 7/1983 Fleming ..... 200/340

FOREIGN PATENT DOCUMENTS 0046575 3/1982 European Pat. Off. ..... 400/496

OTHER PUBLICATIONS

Harris, *Self-Biasing Space Bar Stabilizer Mechanism*, Feb. 1979, pp. 3725-3726.

*Primary Examiner*—John W. Shepperd

*Assistant Examiner*—Renee S. Kidorf

*Attorney, Agent, or Firm*—Donald D. Mondul; Thomas W. Buckman

[57] ABSTRACT

A key cap and switch are provided for an electronic keyboard apparatus such as an electronic typewriter, a computer, or other data input apparatus. A torque rod is provided which is mounted pivotally directly on the switch and interconnects by sliding and pivoting connection with opposite ends of the key top, and thus to prevent tipping of the key top if an off center depressing force is applied thereto. Since the torque rod is mounted on the switch and interconnects with the key top it can be preassembled with these parts and need not be assembled with the switch mounting panel or any other fixed parts of the apparatus.

10 Claims, 6 Drawing Figures

KEYSWITCH CONFIGURATION WITH TORQUE ROD HOLDER

BACKGROUND OF THE INVENTION

Keyboards as used in electronic typewriters, computer terminals, and other data entry devices often use discreet switches having individual keytops or key caps secured to movable parts of the switch mechanisms, and which upon depression operate the switches. Most such switches, for example letter and number switches, are but a single station in width and a struck by the fingers sufficiently close to the center thereof as to cause no particular problems upon depression. However, other key tops such as for space bars, tab set or operation, etc., are more than one station wide. The operator or typist may frequently engage such key tops rather considerably off center. This tends to cause tipping and binding either of the key tops or of the switch mechanisms to which they are attached.

Efforts have been made in the past to utilize torsion bars mounted on a fixed part of the apparatus with end portions thereof received in the key caps adjacent the ends thereof to prevent such tipping. One such arrangement is shown in U.S. Pat. No. 4,384,796. Such torsion bars typically have required pivotal attachment points on the switch plate or bed, either formed in place or as separate fixtures.

Assembly of the various parts has often proved difficult or time consuming, whereby the prior art has been less than completely satisfactory.

SUMMARY AND OBJECTS OF THE DISCLOSED EMBODIMENT

It is an object of the present invention to provide in an electronic keyboard a switch and key top assembly in which a torsion bar is preassembled with the switch and key top assembly.

In accordance with the present invention an electromechanical switch is provided for use with an electronic keyboard. The switch includes a fixed body adapted to snap into place in a keybed or plate, and has a movable plunger actuating internal contact means. The body is molded of plastic material, and the body includes a channel for receipt of a torsion bar, which channel is provided with integral teeth over which the bar snaps for retention in operating position. A key cap snaps into assembled relation with a depressible operating member of the switch, and this key cap is provided with slots receiving the arms of the torsion bar in pivoting and sliding arrangement. The switch mechanism, the key top and the torsion bar or rod are all preassembled before placing the switch mechanism and key top in the electronic keyboard.

THE DRAWINGS

The present invention will best be understood with reference to the ensuing description when taken in connection with the accompanying drawings wherein.

DETAILED DISCLOSURE OF THE ILLUSTRATED EMBODIMENT

Figure 1:
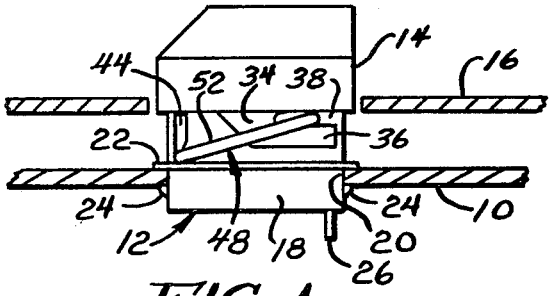
FIG. 1 is a side view of a key top and switch arrangement embodying the present invention, shown as mounted in an electronic keyboard.
Figure 2:
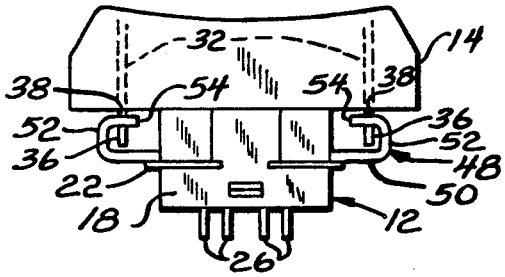
FIG. 2 is a rear view taken from the right end of FIG. 1.
Figure 3:
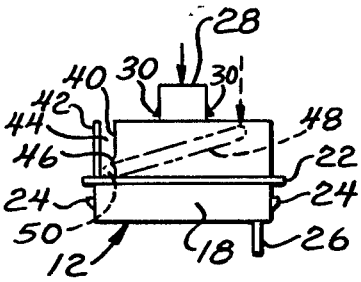
FIG. 3 is a view of the key switch alone taken from the same side as FIG. 1 and showing the structure by which the torsion or torque rod is assembled with the key switch.
Figure 4:
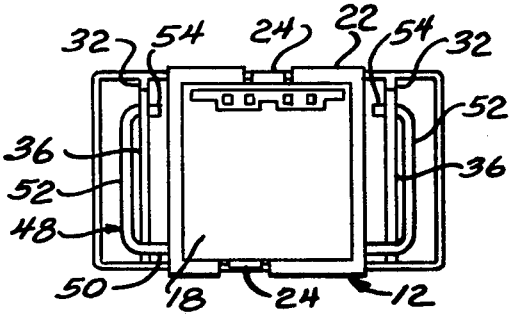
FIG. 4 is a bottom view of the switch, key top and torque rod assembly.
Figure 5:
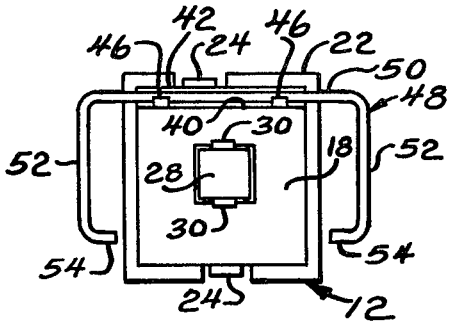
FIG. 5 is a top view corresponding to FIG. 3.
Figure 6:
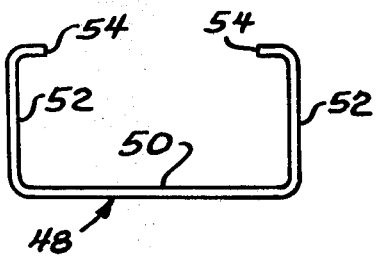
FIG. 6 is a top view of the torque rod.

Turning now in greater particularity to the drawings, there is shown a portion of a keyboard assembly in an electronic typewriter, computer terminal, or other data entry device or apparatus, including a switch bed or plate 10 a keyswitch 12, a key top 14, and a cover plate or panel 16 spaced above the plate or panel 10. The switch 12 comprises a body 18 of molded plastic insulating construction of square outline and of somewhat less height than transverse dimension. The switch mounting plate or panel 10 is provided with a plurality of spaced apertures 20 of which only one is shown, there being one for each switch. The switch is provided with a peripheral flange 22 on the body 18 which abuts the top of the panel 10 adjacent the aperture. A pair of oppositely disposed cam teeth 24 snap under the panel in the vicinity of the aperture to mount each switch in place. Conductive terminals 26 depend from the switch and are selectively interconnected by internal switch contacts, (not shown) which are controlled by a depressible switch actuator 28. The switch actuator 28 is square in cross section, and the upper end is received in a depending, integral sleeve on the underside of the key cap 14. This sleeve is not illustrated since the key cap and the switch actuator are old. The switch operator is provided with lateral teeth 30 for a snap-over engagement with complementary structure on the depending sleeve of the key top. Various details of structure of the switch are not shown since they are old and are of no consequence to the present invention.

The key top 14 illustrated is in many respects old, and comprises a hollow plastic molding having a concave upper surface and open at the bottom. The key top is greater than one station in width, and could be much greater in the case of a space bar. The important thing is that the key top is sufficiently greater in width than one station that an operator's finger can easily engage the key top adjacent one end thereof, and this would cause a tipping of the key top and associated structure which could cause binding or other malfunctioning. To prevent such tipping the key top is provided with internal front-to-back internal walls 32 having depending flanges 34 centrally thereof which extend forwardly as fingers 36, each defining with the overlying wall 32 and the flange 34 a rearwardly edge opening slot 38.

The upper portion of the switch 12 is provided with a front wall 40, and a relatively thin upstanding wall 42 is disposed forwardly thereof. The front face or wall and the upstanding wall 42 define between them a channel 44. The upstanding wall 42 is therefore nominally resiliently flexible with respect to the front wall 40 about the juncture of the upstanding wall 42 in the body 18 of the switch 12 to facilitate assembly of the torque rod 48 and the switch 12, as shall be described in detail hereinafter. The front face or wall 40 is provided near the bottom portion thereof with a pair of forwardly extending triangular teeth 46 disposed relatively adjacent the opposite sides of the switch 12.

A torque rod 48 is provided which has a body or bight portion 50 comprising an elongated rod like member, constructed of steel wire of sufficient thickness as to be functionally rigid in the overall size of the torque rod. The torque rod also comprises parallel side arms 52 integral with and at right angles to the body or bight 50, and inwardly directed ends 54 confronting one another in spaced relation and parallel to the body or bight 50, the ends being integral with the arms 52.

The bight or body 50 of the torque rod 48 is received in the channel 44, snapping over the triangular teeth 46 upon lateral installation as permitted by the resiliency of the integral wall 42. The bight thus is held in pivotal mounted position at the bottom end of the channel. The arms 52 extend diagonally upwardly and rearwardly therefrom to a position adjacent the slots 38 above the fingers 36, the in turned ends 54 being received in the slots 38.

Upon normal, centralized depression of the key top 14 the key top and upper portion of the switch are pressed straight down. The torque rod ends 54 pivot and slide in the slots 38, while the bight or body 50 of the torque rod pivots in the bottom of the channel 44. If an operator presses on the key top 14 adjacent one end thereof this causes the key top to push down on the adjacent end 54 of the torque rod. The torque rod pivots and causes the other end 54 thereof to push down on the respective finger 36, whereby the key top is moved straight down without any tipping, notwithstanding the tipping force impressed by the operator's offset finger.

It will be observed that upon manual depression of the key top there is a downward force as well as a turning force on the bight or body 50, thus more snugly holding the bight in the bottom of the channel 44. It will also be apparent that the ends 54 of the torque rod pivot within the slots 38, and also move fore and aft within the slots 38. When the key top is manually released it is returned to raised position by an internal spring within the switch 18. This spring may be supplemented or supplanted by other resilient means beneath the key top and now shown herein.

It is important to observe that the torque rod can be preassembled with the switch and the key top. This preassembled unit then is simply pushed straight down with the switch snapping through the respective aperture 20 in the mounting panel or plate 10. It is not necessary to effect any independent interconnection of the torque rod with the mounting plate or panel 10 or any parts thereon. This materially simplifies assembly of the keytop, the torque rod, and the switch with the balance of the apparatus, and particularly the panel or plate 10.

The specific example as herein shown and described will be understood as being for illustrative purposes. Various changes in structure will no doubt occur to those skilled in the art and will be understood as forming a part of the present invention insofar as they fall within the spirit and scope of the appended claims.

The invention is claimed as follows:

1. A keyswitch construction for electronic data entering apparatus comprising a keyswitch having a body, means on said body for mounting a torque rod, a key top disposed adjacent said body and manually movable toward and away from said body, means on said key top receiving said torque rod, and a torque rod mounted to said body and said key top and comprising a bight, a pair of said arms on said bight, and a pair of deflected tips respectively on said arms, said bight being mounted on said body said arms extending astride said body and said tips being received by the torque rod receiving means on said key top.

2. A keyswitch construction according to claim 1 wherein said body torque rod mounting means and said key top torque rod receiving means both comprise pivotal connections with said torque rod and said keytop torque rod receiving means comprises also a sliding connection with said torque rod.

3. A keyswitch construction as set forth in claim 1 wherein said key top has a pair of spaced members thereon extending therefrom toward said keyswitch and lying on opposite sides of said body, said members each having a slot therein receiving the tips of said torque rod.

4. A keyswitch construction as set forth in claim 3 wherein the slots are oriented transversly of the direction of motion of said key top.

5. A keyswitch construction as set forth in claim 4 wherein said slots are edge opening at one end of each slot.

6. A keyswitch construction as set forth in claim 1 wherein said body has means providing a channel therein extending parallel to the direction of motion of said key top and receiving said torque rod bight.

7. A keyswitch construction as set forth in claim 6 wherein said channel is edge opening toward said key top.

8. A keyswitch construction as set forth in claim 7 wherein said channel is defined by a fixed wall on said body and a resilient wall spaced therefrom, said fixed wall having teeth thereon over which the bight of said torque rod snaps into position against the resiliency of said resilient wall.

9. A keyswitch construction for electronic data entering apparatus comprising a keyswitch having a body, a key top disposed adjacent said body and interconnected therewith for manual movement toward and away from said body, and a torque rod comprising a bight, a pair of side arms on said bight said side arms extending astride said body, and a pair of deflected tips respectively on said arms, said body having a fixed wall thereon parallel to the direction of motion of said key top and a resilient wall parallel to and spaced from said fixed wall defining a channel opening at one end toward said key top, the fixed wall having at least one tooth thereon over which said bight snaps for retention in said channel, said key top having a pair of projections thereon spaced on opposite sides of said body and defining slots perpendicular to the direction of motion of said key top, said slots receiving the ends of said torque rod.

10. A keyswitch construction as set forth in claim 9 wherein said slots are open at one end.

* * * * *